US005314356A

United States Patent [19]

Isohata et al.

[11] Patent Number: 5,314,356

[45] Date of Patent: May 24, 1994

[54] CONNECTOR AND METHOD FOR VARIABLE POLARIZATION

[75] Inventors: Shigeru Isohata, Machida; Hisayoshi Wakamatsu, Kawasaki, both of Japan

[73] Assignee: The Whitaker Corporation, Wilmington, Del.

[21] Appl. No.: 973,224

[22] Filed: Nov. 6, 1992

Related U.S. Application Data

[63] Continuation of Ser. No. 807,932, Dec. 16, 1991, abandoned.

[30] Foreign Application Priority Data

Jan. 18, 1991 [JP] Japan ..... 3-016821

[51] Int. Cl.[5] ..... H01R 13/645

[52] U.S. Cl. ..... 439/681; 439/680

[58] Field of Search ..... 439/677-681, 439/488; 29/747

[56] References Cited

U.S. PATENT DOCUMENTS

| | | | |
|---|---|---|---|
| 3,177,462 | 4/1965 | Särnmark | 439/681 |
| 3,611,272 | 10/1971 | Fairbairn | 439/681 |
| 4,066,321 | 1/1978 | Villazon | 439/488 |
| 4,376,565 | 3/1983 | Bird et al. | 439/681 |
| 4,557,547 | 12/1985 | Stuart | 439/677 |
| 4,596,436 | 6/1986 | Kraemer et al. . | |
| 4,773,881 | 9/1988 | Adams | 439/681 |
| 4,795,356 | 1/1989 | Pauza | 439/577 X |
| 4,820,204 | 4/1989 | Batty | 439/681 |
| 4,832,625 | 5/1989 | Puerner | 439/681 |
| 4,911,651 | 3/1990 | Jego et al. | 439/681 X |
| 5,000,701 | 3/1991 | Norden | 439/680 |

FOREIGN PATENT DOCUMENTS

| | | | |
|---|---|---|---|
| 355995 | 2/1990 | European Pat. Off. . | |
| 3601115 | 7/1987 | Fed. Rep. of Germany | 439/680 |
| 2438351 | 10/1979 | France . | |
| 128460 | 6/1987 | Japan . | |
| 49174 | 3/1991 | Japan | 439/677 |
| WO-/A/8809572 | 12/1988 | World Int. Prop. O. . | |

*Primary Examiner*—Eugene F. Desmond
*Attorney, Agent, or Firm*—Timothy J. Aberle

[57] ABSTRACT

A connector (C1) includes a housing (10) and a pair of terminals (T1) adapted to interconnect to a pair of wires (W1, W2) to electrically connect with terminals (33, 35) of a connector (R1); wherein the connector has a key (20) that is movably latchable in the housing in one of two positions in accordance with the orientation of the wires as terminated to terminals (T1) to form an appropriate connector orientation relative to a keyway and the mating connector and assure proper mating of connectors and wires, despite random orientation of wires as terminated.

14 Claims, 2 Drawing Sheets

CONNECTOR AND METHOD FOR VARIABLE POLARIZATION

This application is a continuation of application Ser. No. 07/807,932 filed Dec. 16, 1991, now abandoned.

This invention relates to an electrical connector having variable polarization to enable random interconnection to pairs of wires.

BACKGROUND OF THE INVENTION

Electrical connectors may be terminated to the ends of electrical wires or in between the ends to form tap connections. When this is done with respect to cables having pairs, or multiples of pairs of wires, and particularly with respect to twisted pairs of wires, care must be taken to properly orient the wires relative to the connectors and the terminals thereof to assure that the appropriate wires relative to voltages, signal, and grounding pathways are maintained.

A conventional example of a tap connector utilized with multiple wires is disclosed in Japanese Patent Number 128460/1987. In a use of such connectors, the wires are typically numbered or colored to identify the appropriate wire relative to the terminals of the connector. One problem with such use, particularly experienced with automatic termination through machines arises by virtue of the fact that the wires must be identified in some way prior to termination. This results in either an opportunity for error, or a requirement that the wires be fed in a precise way with some means of detecting the color or identification of the wire in order to assure proper termination. If errors are made and the wire is improperly terminated, the wiring harness resulting therefrom is typically scrapped as it cannot be repaired economically.

It is an object of the present invention to provide a novel connector capable of being randomly terminated to electrical conductor wires, such as twisted pair wires. It is a further object to provide a tap connector capable of being interconnected to a pair of wires at the ends or intermediate the ends of a cable without the need to initially identify the orientation of the wires. It is still a further object to provide an improved method for terminating multiple conductor wires, and particularly twisted pair wires, to electrical connectors for use in a harness.

SUMMARY OF THE INVENTION

In accordance with the invention, a connector and method therefor is utilized which enables the random termination of multiple conductor wires. The connector includes mating connector halves in the form of plug and receptacle, which contain mating terminals. One of the halves typically includes a provision wherein the terminals thereof are terminated to a pair of wires such as a twisted pair of a cable without regard to the identity or orientation of the wires relative to the connector. The connector so terminated has a key which can be moved in accordance with a later identity of the wires to occupy one of two positions altering the profile of the connector half. The alteration, by displacement of the key, requires that the terminated half itself be oriented relative to a keyway provided on the opposite connector half; the key of one half fitting in the keyway of the other half during intermating. The connector half, which is terminated, includes latch surfaces which are engaged by key latches to latch the key in one of the two positions to thus polarize the connector half relative to its mating half.

In one embodiment, the invention housing terminated to wires includes an aperture through which a key is adapted to slide into one or the other of two positions and be latched thereby. In a further embodiment, the key is formed integrally with the housing and made to extend from the sides thereof to be either snapped into grooves of the housing and frictionally therein or left to project from the housing. An appropriate keyway or keyways can be provided in the mating connector half to accommodate an orientation for intermating of the connector halves and the multiple wires terminated thereby.

In accordance with the method of the invention, it is contemplated that connectors having the feature of the invention are first randomly terminated to multiple wires, such as twisted pair wires, and thereafter, the particular wire orientation is identified with the key of the connector manipulated to an appropriate position to force the connector to be oriented relative to its mating half in an appropriate position. Thereafter, the connector halves are mated with the key, keyway feature of the invention, resulting in an appropriate interconnection.

IN THE DRAWINGS

DETAILED DESCRIPTION OF THE INVENTION

Figure 1:
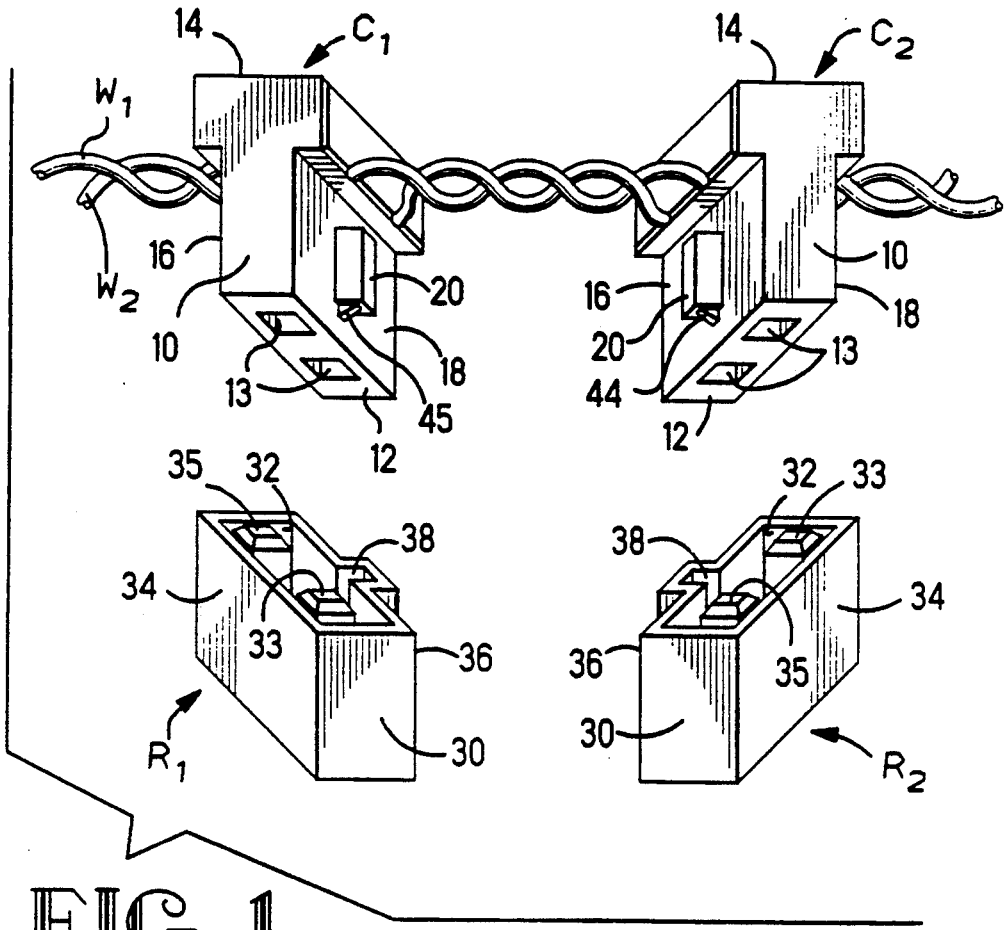
FIG. 1 is a perspective exploded view showing a pair of connectors in accordance with the invention terminated to a twisted pair of wires with connector halves prior to mating.
Figure 2:
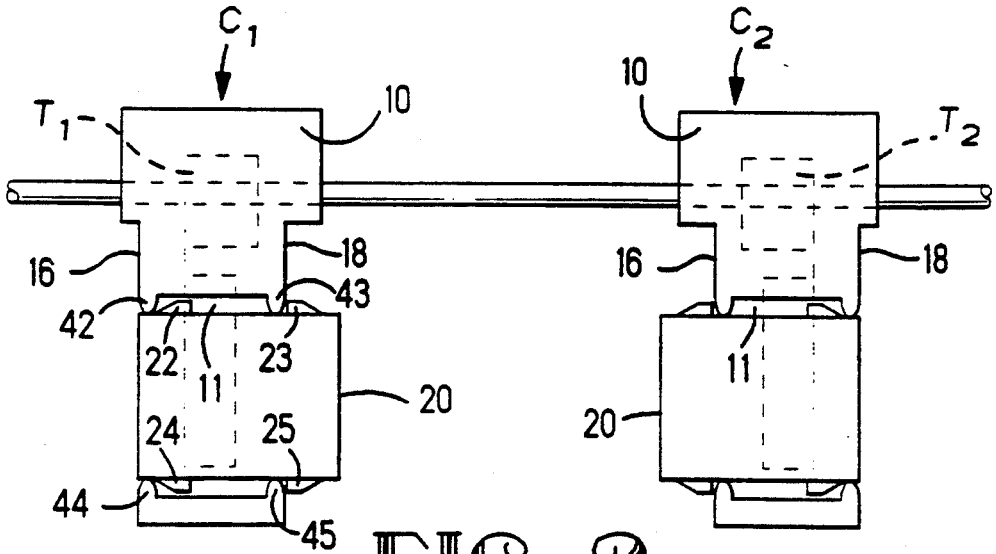
FIG. 2 is a side elevational view showing the connector halves terminated to wires, the terminals shown in phantom, and including keys in two different positions relative to the connector housings.

Illustrated in FIG. 1 is a simplified view of one embodiment of a tap connector in accordance with the present invention. A pair of first connectors C1, C2 each include two receptacle contacts (not shown) which are terminated individually to one of two electrical conductor wires W1, W2 of a twisted pair of wires forming a cable such as a jumper cable or a portion of a daisy chain which interconnects circuits and components. Each of the receptacle contacts may typically include a box-shaped receptacle portion extending within a plastic connector housing 10 to a mating face 12 and aligned with apertures 13. The profile of the terminals T1, T2 is shown in phantom in FIG. 2 extending through the housing 10. Also shown in FIG. 2 is an aperture 11 which extends through the sides of the housing 10. The contact terminals T1 and T2 may be insulation displacement contacts (IDC) which are well known to include a slotted plate of terminal material which serves to penetrate the insulation of a conductor wire and grip the conductive strand or strands contained therein to provide an interconnection to the wire. The IDC-type termination may be effected by a portion of the connector housing, such as a cap which pushes the wires into the slot of the terminal; or, alternatively, may be achieved through the use of an IDC tool which serves to push the wire into the appropriate slot with a cap thereafter being added to the housing to hold the wire in place. Such cap 14 may be applied to the housing as shown in FIG. 1.

As can be discerned from FIG. 1, the pair of connectors C1, C2 are connected to the twisted pair of wires W1 and W2 such that the wires are relatively reversed as between the connectors C1 and C2, noting the orientation of the wires relative to the sides 16 and 18 of the housings 10 of the two connectors. The invention contemplates that any number of connectors C1, C2 may be applied to the conductor wires W1 and W2 at the end of such wires or intermediate such ends and along the length of the cable formed by the wires. The invention also contemplates that this step of termination of a given connector C1, C2 may be done randomly without a determination during termination of the particular orientation of the wire relative to the connector and the terminal receptacles therein.

FIG. 1 also shows a pair of connector receptacles R1, R2 having housings 30 which each include an interior recess 32 and contain contact terminals in the form of pins 33 and 35 extending therewithin. Each of the housings 30 further include side surfaces 34 and 36 with a groove 38 projecting from the side surface 36 as shown. The recess 32 is of a cross-sectional dimension to receive, in mating engagement, the plug portion of the connectors C1, C2 in a manner so that the contact pins 33 and 35 will enter the apertures 13 and engage the terminals within the housings 10. Given the orientation of wires W1, W2 relative to the connectors C1, C2 shown in FIG. 1, an engagement of the connectors with the receptacles R1 and R2 would result in a reversal of circuit paths and an improper interconnection.

To that end, each of the housings 10, including the apertures 11, are made to include a key 20 which is movable from within the housing to project outwardly from side 16, in one instance, or side 18 in another instance. The keys 20 for the connectors C1, C2, which may be seen projecting from the sides 16,18 of connectors C1 and C2 in FIGS. 1 and 2, each include upper latches 22,42; 23,43 and lower latches 24,44; 25,45. The latches 22–25 are positioned on the key 20 so as to engage latches 42–45, shown in FIG. 2 to latch the key 20 in a fixed position projecting from one side 16 or the other side 18 of a connector C1, C2. Thus, the key 20 is shown projecting from the right side of connector C1 and from the left side of connector C2 relative to the keyways 38 of such connectors, as shown in FIG. 2. As shown in FIG. 1, the keys 20 are oppositely oriented to require a manipulation of the connector C2 relative to the receptacle R2, note the orientation shown in FIG. 1 wherein the conductor wire W1, through the receptacle in connector C1, would be interconnected with contact pin 33 relative to R1 and also contact pin 33 relative to R2.

The invention concept, connector and method, allows for a random termination of the connectors C1, C2 to the cable formed by conductor wires W1, W2. This is followed by a continuity test to check the interconnection of the connectors to the wires W1, W2, which test will identify the orientation resulting from the interconnection as well as providing a level of quality control as to the interconnection. With the identification of wires, the key 20 of a given connector C1, C2 may be manipulated within the keyway 38 to force an orientation of the connector relative to the receptacle and thus assure a proper interconnection.

The invention contemplates that the key 20 may be manipulated manually through an operator in fabricating a harness made of the component shown, or may be driven automatically by an air cylinder or an electromagnetic plunger associated with a continuity test.

Figure 3:
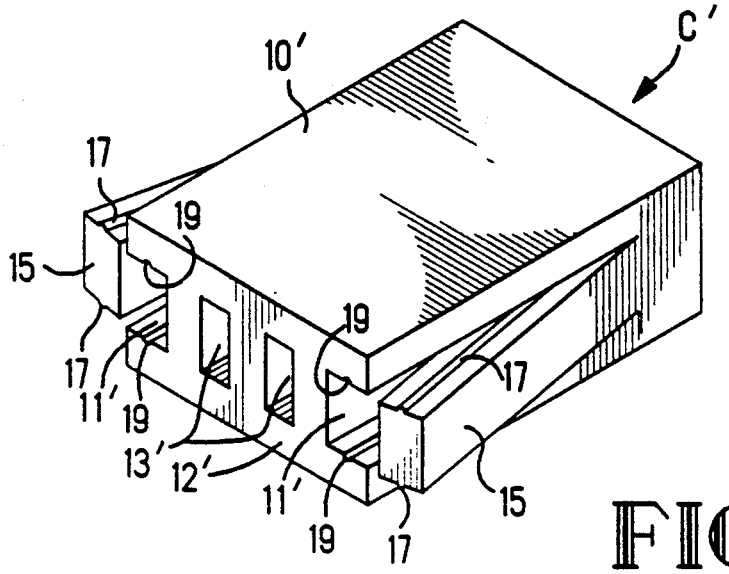
FIG. 3 is a perspective view of an alternative embodiment of the connector housing of the invention.
Figure 4:
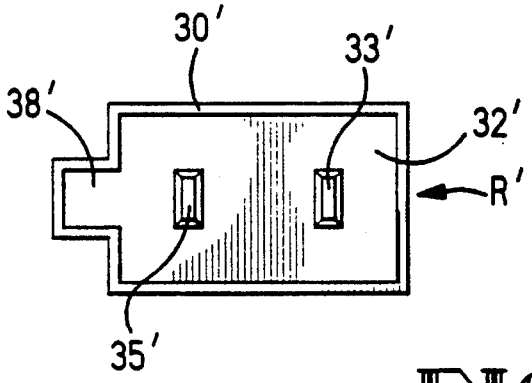
FIG. 4 is a front elevational view of a connector half intended to mate with the connector half shown in FIG. 3.

FIG. 3 shows an alternative embodiment of the invention, including a connector C' having a housing 10'. The housing 10' includes receptacle terminals which are to be interconnected to wires in a manner not shown but essentially like that shown with respect to FIGS. 1 and 2. Opposite to the wire termination end is a face 12' containing a pair of apertures 13' which lead to receptacles within housing 10'. On the sides of the housing 10' are grooves 11' which include recesses 19 at the top and bottom of such grooves. A key 15 is formed on each side of housing 10' and includes a pair of ridges or ribs 17 which project from the top and bottom thereof as shown in FIG. 3. The keys 15 are made integral with the housing 10' in the embodiment shown in FIG. 3 and are hingedly mounted thereto at inner ends thereof. Housing 10' is accordingly molded with the keys 15 positioned outwardly and the grooves 11' molded therein. Thereafter, the keys may be selectively forced into the housing 10', the keys 15 and the ridges 17 thereof lodging in grooves 11' and recesses 19 to latch the keys in position. As can be seen in FIG. 4, a receptacle connector R' is made to include a housing 30' with terminals 33' and 35' and a keyway 38' on one side thereof. The interior recess 32' is made to have a configuration to accept the connector 10' with one and only one of the keys 15 left projecting from the side thereof. In this way, the selective manipulation of the keys 15 forces polarization or orientation of the housing 10' and therefore the wires, not shown, terminated thereto.

The invention contemplates that the housings shown are to be made of standard engineering plastic having appropriate dielectric qualities. The invention further contemplates that a variety of different types of terminals may be employed with respect to the connector, including IDC and other types of terminations. Additionally, the keys 20 and 15 may not be limited to push-in types, but may have a pair of keys on the outer surface of the housing to be selectively moved or displaced for polarization purposes. The key 15 may in fact be made separate from the housing 10 and attached thereto by appropriate means.

Having now disclosed the invention in terms intended to enable a preferred practice thereof, claims are set forth defining the invention.

We claim:

1. An electrical connector including first and second mating connector halves for connecting a pair of twisted wires thereby, each half having a dielectric housing having a given mating axis including terminals contained therein and adapted to be interconnected to the pair of wires in a T-tap interconnection transversely oriented to said given mating axis, said first half housing including key means for reciprocating a given external profile from first and second positions and said second half including a single key way adapted to receive said key means and thereby require and second positions and said second half including a single key way adapted to receive said key means and thereby require one or the other of two rotational orientations of said first half relative to said second half for intermating said halves together to orient said wires, characterized in that said key means external profile movably reciprocates from said first position protruding from an outside surface of the first housing to a second position protruding from an opposite outside surface of the first housing relative to said first half housing and includes detent means to latch said key means in at least one of the two protruding positions to provide said particular orientation of halves and wires.

2. The connector of claim 1 characterized in that said first half housing includes an aperture extending transversely therethrough and the said key means is displaceable from one side surface of said first half housing to the other side surface thereof.

3. The connector of claim 1 characterized in that said first half housing includes an aperture therethrough and said key means is fitted for sliding movement in said first half housing with said means to latch said key means including latching surfaces on said key means and on said housing.

4. The connector of claim 1 characterized in that said key means is separable from the said first half housing.

5. The connector of claim 1 characterized in that said key means is integrally formed with said first half housing.

6. A method for randomly interconnecting a twisted pair of wires to a plurality of identical connectors of a type having intermating connector halves including the steps of:

a. providing for each of the plurality of connectors a first half having a housing including a key means displacable in at least one of two latched positions and a second half having a housing and a keyway in one side of the housing;

b. randomly terminating the twisted pair of wires to the first half of each of the connectors;

c. identifying the orientation of the terminating wires in each said first half connectors;

d. displacing said key means of one or the other first half connectors to one or the other positions in accordance with the identification of wire orientation; and e. positioning one of the first halves as keyed to fit within the keyway of the second connector half in a mating fit to assure proper orientation of wires and connector halves.

7. An electrical connector for electrical connection to a twisted pair of electrical wires and to orient the connector for polarized connection to a matable electrical connector, the electrical connector having an insertion direction and comprising:

a dielectric housing having electrical terminals secured therein for random electrical connection to the wires of the twisted pair of electrical wires and further including a pair of opposing exterior side surfaces;

key means as an internal but adjustable part of said housing wherein the key means is extendable and retractable relative to said opposing exterior side surfaces in a direction which is generally transverse to the insertion direction of said connector for selectable positioning outwardly from either side of said housing for matable engagement with a keyway of the matable electrical connector for polarized connection to the matable electrical connector; and latching means on the housing and the key means to maintain the key means in extended or retracted positions, and wherein said latching means on said key means includes a first projection which extends in a generally transverse direction relative to a longitudinal axis of said key means.

8. An electrical connector as claimed in claim 7, wherein said key means is separate from said housing and slidably movable relative to said housing.

9. An electrical connector as claimed in claim 7, wherein said key means are members integrally formed with said housing by being hingedly connected thereto and being disposed in grooves in the sides of said housing or extend outwardly from the sides.

10. An electrical connector as claimed in claim 9, wherein said latching means comprise ribs on said members and recesses in said grooves.

11. The connector of claim 7 characterized in that said housing includes grooves extending along the sides thereof and said key means extends along the sides of the housing and is adapted to fit within said grooves or extend therefrom.

12. The connector of claim 7 characterized in that said housing includes a plurality of grooves therein and said key means includes a plurality of projections.

13. The connector of claim 7 characterized in that said key means is hinged to said housing through an integral portion of said housing.

14. An electrical connector for electrical connection to a twisted pair of electrical wires and to orient the connector for polarized connection to a matable electrical connector, the electrical connector having an insertion direction and comprising:

a dielectric housing having electrical terminals secured therein for random electrical connection to the wires of the twisted pair of electrical wires;

key means as part of said housing for selectable positioning outwardly from either side of said housing for matable engagement with a keyway of the matable electrical connector for polarized connection to the matable electrical connector;

latching means on the housing and the key means to maintain the key means outwardly from either side of the housing;

said key means being movable relative to said housing in a direction which is generally transverse to the insertion direction of said connector, an aperture being provided to enclose the key means;

and wherein said latching means comprise first projections on said housing and second projections on said key means.

* * * * *

UNITED STATES PATENT AND TRADEMARK OFFICE

CERTIFICATE OF CORRECTION

PATENT NO. : 5,314,356
DATED : May 24, 1994
INVENTOR(S) : Isohata et al.

It is certified that error appears in the above-indentified patent and that said Letters Patent is hereby corrected as shown below:

Col 4, claim 1, line 11-13, delete "and thereby require and second positions and said second half including a single key way adapted to receive said key means"

Signed and Sealed this
Twenty-third Day of May, 1995

*Attest:*

*Attesting Officer*

Bruce Lehman

BRUCE LEHMAN

*Commissioner of Patents and Trademarks*